US005879140A

United States Patent [19]

Ellison

[11] Patent Number: 5,879,140

[45] Date of Patent: Mar. 9, 1999

[54] OIL PUMP PICKUP DEVICE FOR USE WITH AN INTERNAL COMBUSTION ENGINE

[76] Inventor: Thomas W. Ellison, 9045 Schlottman Rd., Maineville, Ohio 45039

[21] Appl. No.: 804,807

[22] Filed: Feb. 24, 1997

[51] Int. Cl.[6] ..... F01C 1/18

[52] U.S. Cl. ..... 417/310; 417/364; 417/313; 418/206.1; 184/6.24

[58] Field of Search ..... 417/310, 313, 417/364, 423.3, 423.9; 418/206.1, 206.4; 184/6.24, 6.16; 415/121.2

[56] References Cited

U.S. PATENT DOCUMENTS

| | | | |
|---|---|---|---|
| 1,921,670 | 8/1933 | Gulick | 184/6 |
| 1,989,816 | 2/1935 | Meyer | 184/6 |
| 3,592,293 | 7/1971 | Frincke | 184/6 |
| 3,628,893 | 12/1971 | Carpigiani | 417/310 |
| 3,727,725 | 4/1973 | Dahm | 184/6.24 |
| 4,586,468 | 5/1986 | Dzioba | 417/364 |
| 4,834,040 | 5/1989 | Yoshida . | |
| 4,862,995 | 9/1989 | Faria | 417/310 |
| 5,044,469 | 9/1991 | Liu . | |
| 5,190,120 | 3/1993 | Watts . | |

*Primary Examiner*—Charles G. Freay
*Attorney, Agent, or Firm*—Mark F. Smith; Smith, Brandenburg, Freese & Knochelmann

[57] ABSTRACT

An oil pickup device is provided which is adapted to replace the standard oil pump cover plate and pickup tube typically utilized for use with a conventional oil pump for an internal combustion engine. The oil pickup device comprises an oil pump mounting section having a front wall which complimentarily conforms with the mating surfaces of the pump housing to provide an oil seal and for segregating the discharge chamber of the oil pump, and an oil pickup section for extending into the oil contained in the engine supply reservoir formed within a conventional oil pan to provide a continuous supply of oil to the oil pump. The oil pickup device further includes an oil filter or screen positioned between the oil pump mounting section and the oil pickup section for filtering inlet oil to prevent particulate matter, such as dirt or metal shavings, from entering into the oil pump. In operation, oil is continuously picked up from the oil supply reservoir through an opening in the oil pickup section by suction produced by the oil pump and is directed through the oil pickup section and the oil pump mounting section and into the suction chamber of the oil pump.

20 Claims, 5 Drawing Sheets

OIL PUMP PICKUP DEVICE FOR USE WITH AN INTERNAL COMBUSTION ENGINE

BACKGROUND OF THE INVENTION

This invention relates to an oil pump pickup device for use with an internal combustion engine, and more particularly, to an oil pump pickup device for use with an internal combustion engine such as used in an automobile for racing and which is effective for maintaining a sufficient supply of oil under various driving conditions.

Internal combustion engines, such as used in automobiles for racing, utilize an oil pump for continuously pumping oil from an engine oil supply reservoir formed within an oil pan, through an oil circulating system to lubricate the various parts of the engine, and for discharging the oil back into the oil reservoir. The oil pump is typically a conventional gear-type pump comprising a cast iron housing having a suction or inlet chamber, a discharge or outlet chamber, an oil intake in flow communication with the suction chamber, an oil discharge in flow communication with the discharge chamber, and a flange for mounting the pump onto the engine structure.

The oil pump pickup device used in automobiles for racing, as well as many passenger automobiles, for delivering oil from the engine oil supply reservoir to the suction chamber of the oil pump housing typically comprises a cantilevered oil tube having an upper end fixedly secured to the oil intake of the oil pump housing by bolts, and a lower end having a substantially horizontal extension with an inlet therein which extends into the oil contained within the engine oil supply reservoir. A screen or filter is typically provided across the oil inlet for eliminating air bubbles in the oil and for preventing particulate matter, such as dirt or metal shavings, from entering into the oil pump.

During operation, oil is continuously picked up from the oil supply reservoir through the oil inlet in the horizontal extension of the oil pump pickup tube and delivered to the oil pump inlet. One problem, however, commonly associated with oil pump pickup tubes is that the connection between the oil pump housing and the upper end of the oil pump pickup tube often breaks thereby resulting in a loss of oil circulation which can endanger the engine. Attempts have been made to solve this breaking problem by welding the steel pickup tube to the cast iron pump housing. Unfortunately however, because of the difficulty of welding steel to cast iron, this solution has not been totally successful, particularly for high r.p.m. engines such as used for racing. Accordingly, it has become common practice to periodically remove and replace the pickup tubes. This procedure, however, is both relatively time consuming and expensive and does not ensure that the connection between the pickup tube and the oil pump inlet will not break during periods of high stress.

Another problem commonly associated with oil pump pickup tubes typically used with internal combustion engines for automobiles is preventing the aspiration of air under all vehicle operating conditions. For example, when the automobile is stationary, the oil in the reservoir seeks the lowest level within the reservoir which is normally the oil sump portion of it. When the automobile is being driven through curves, or over inclines or descents, or during forward acceleration or breaking, the oil tends to shift and may result in the intake of the pickup tube not being sufficiently covered by oil to prevent air from entering the oil pump causing oil starvation which may result in damage to the engine.

Various devices have been developed to prevent the aspiration of air under the described conditions. Unfortunately however, such devices are often relatively expensive to manufacture or are not easily installed in a conventional automotive oil circulation system.

Accordingly, a need exists for an oil pickup device for use with an oil pump for an internal combustion engine which is relatively inexpensive to manufacture, can be easily installed in a conventional automotive oil circulation system, will not break during operation, and which will prevent or reduce the aspiration of air during various driving conditions.

SUMMARY OF THE INVENTION

The present invention is directed to an oil pickup device for use with a conventional oil pump for an internal combustion engine. The oil pump pickup device is adapted to replace the standard oil pump cover plate and pickup tube typically utilized in oil pump assemblies. The oil pump pickup device comprises an oil pump mounting section having a generally rectangular front wall which complimentarily conforms with the mating surfaces of a conventional oil pump housing to provide an oil seal and for segregating the discharge chamber of the oil pump, and an oil pickup section for extending into the oil contained in the engine oil supply reservoir formed within a conventional oil pan to provide a continuous supply of oil to the oil pump.

In a preferred embodiment of the invention, the oil pump mounting section includes a flange extending perpendicularly from the front wall to define an open ended cavity which is in flow communication with the suction chamber of the oil pump by an opening. The oil pickup section includes a generally rectangular upper face having a recess therein and an outer periphery for securing the oil pump pickup section to the oil pump mounting section. The lower face of the oil pump pickup section has an outwardly extending protuberance adapted to extend into the oil contained in the engine oil supply reservoir and includes an opening and a channel for receiving oil and for delivering the oil to the open ended cavity and the suction chamber of the oil pump.

In another preferred embodiment of the invention, the open ended cavity of the oil pump mounting section includes an integral, hollow protuberance for receiving a conventional pressure regulator valve which cooperates with first and second openings for regulating the oil pressure within the pump.

In another preferred embodiment of the invention an oil filter or screen is positioned between the oil pump mounting section and the oil pickup section of the oil pickup device for filtering inlet oil to prevent particulate matter, such as dirt or metal shavings, from entering into the oil pump.

In operation, oil is continuously picked up from the oil supply reservoir through the opening in the outwardly extending protuberance of the oil pickup section by suction produced by the oil pump and is directed into the recess formed in the upper face of the oil pickup section, into the open ended cavity formed in the oil pump mounting section, and out through the opening in the front wall and into the suction chamber of the oil pump where it is then circulated through the oil circulating system of the engine.

A primary object of this invention, therefore, is to provide an oil pump pickup device for use with an internal combustion engine.

Another primary object of this invention is to provide an oil pump pickup device for use with an internal combustion engine such as used in an automobile.

Another primary object of this invention is to provide an oil pump pickup device for an internal combustion engine such as used in an automobile for racing.

Another primary object of this invention is to provide an oil pump pickup device for use with an internal combustion engine such as used in an automobile which is effective for maintaining a sufficient supply of oil under various driving conditions.

Another primary object of this invention is to provide an oil pump pickup device for use with an internal combustion engine which will not break during operation resulting in a loss of oil circulation through the engine.

Another primary object of this invention is to provide an oil pump pickup device for use with an internal combustion engine which does not require periodically removal and/or replacement.

Another primary object of this invention is to provide an oil pump pickup device for use with an internal combustion engine which is relatively inexpensive to manufacture.

Another primary object of this invention is to provide an oil pump pickup device for use with an internal combustion engine which can be easily installed onto a conventional engine oil pump.

Other objects and advantages of the invention will be apparent from the following description, the accompanying drawings and the appended claims.

DETAILED DESCRIPTION OF THE PREFERRED EMBODIMENT

Figure 1:
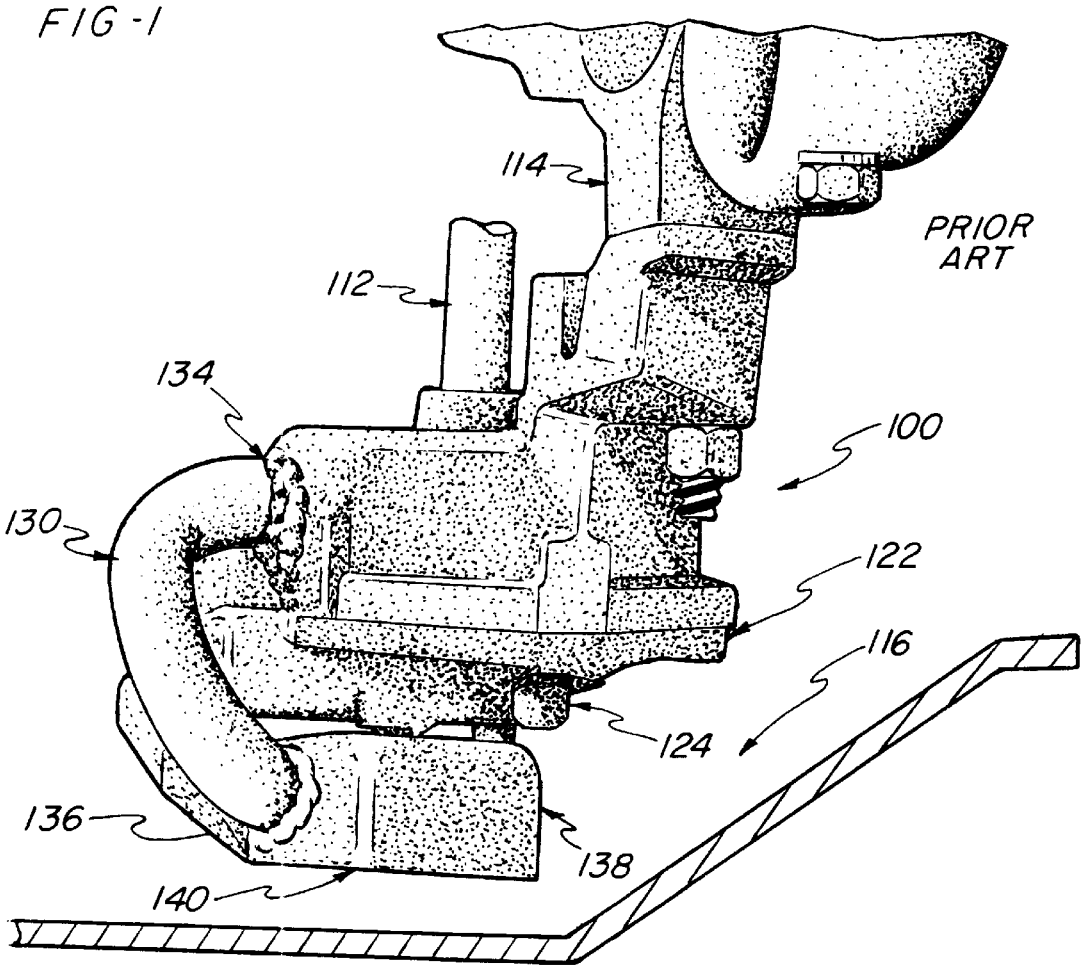
FIG. 1 is a perspective side view of a typical oil pump for use with an internal combustion engine such as used in an automobile for racing having a prior art pump cover and oil pick up tube.
Figure 2:
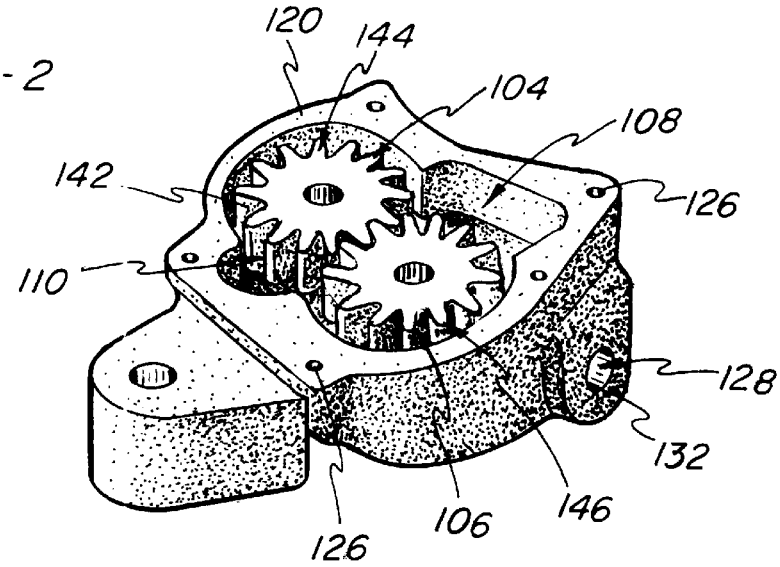
FIG. 2 is an inverted perspective view showing the interior of the typical oil pump of FIG. 1.

Referring to FIGS. 1 and 2, a typical oil pump, generally designated 100, for use with an internal combustion engine (not shown), such as for use in an automobile for racing, is shown comprising a generally cylindrical housing 102, which is made of metal such as an iron-based alloy, enclosing a pair of rotatable pump gears 104 and 106, forming a suction chamber 108 and a discharge chamber 110. The upper pump gear 104 has a rear shaft 112 extending therefrom for engaging with the cam shaft or distributor shaft (not shown) of the engine to drive the pump 100 by rotating the upper pump gear 104 which engages the lower pump gear 106. The oil pump 100 is secured to a depending crank case arm 114 such that it is positioned within the engine oil supply reservoir 116 formed within a conventional oil pan 118. The lower portion of the housing 102 includes an outwardly extending flange 120 which serves as a seat for a cover plate 122 which is secured to the housing 102 by a plurality of threaded bolts 124 inserted through apertures in the cover plate 122 and into corresponding threaded bores 126 in the outwardly extending flange 120. The housing 102 is further provided with an oil inlet 128 which cooperates with an oil pickup tube 130 for providing oil from the engine oil supply reservoir 116 to the suction chamber 108 of the oil pump 100.

The external end 132 of the oil inlet 128 is adapted to receive the upper end 134 of the oil pickup tube 130 which is fixedly supported thereto by welding. To reduce the risk of the connection between the oil pickup tube 130 and the external end 132 of the oil inlet 128 from disengaging or breaking as a result of fatigue, particularly in high r.p.m. engines used in racing, the connection between the oil pickup tube 130 and the oil inlet 128 is often reinforced by a suitable fitting or collar or secured to the housing 102 by screws or other conventional means. Unfortunately, such methods of attaching the oil pickup tube 130 to the oil inlet 128 is relatively expensive and inconvenient or undesirable, and has not been totally successful in preventing the connection between the oil pickup tube 130 and the inlet 128 from breaking. The lower end 136 of the oil pickup tube 130 extends into oil contained in the engine oil supply reservoir 116 and includes a substantially horizontal extension 138 having an oil inlet 140 therein. A screen or filter (not shown) is typically provided at the oil inlet 140 of the horizontal extension 138 for preventing particulate matter, such as dirt or metal shavings, from entering into the oil pump 100 by brazing or other such attaching method. It has been found, however, that such methods of attaching the screen tend to weaken during use. During high stress conditions, the brazing may break thereby allowing particulate matter to enter into the oil pump.

To understand how the parts above described are interrelated, the operation of the oil pump will now be described. During operation, oil is continuously picked up from the engine oil supply reservoir 116 through the oil inlet 140 in the horizontal extension 138 by suction produced by the oil pump 100 and is directed through the oil pickup tube 130 and the oil pump inlet 128 in the oil pump housing 102 to the suction chamber 108 of the oil pump 100. Oil which is delivered to the suction chamber 108 is then carried by the spaces 142 formed by the upper and lower gear teeth 144 and 146, respectively, around the internal housing 102, and to the discharge chamber 110. Oil in the discharge chamber 110 is then directed out through an oil discharge conduit (not shown), secured at one end to the discharge chamber 110, to the oil circulation system for lubricating the various engine components.

Figure 3:
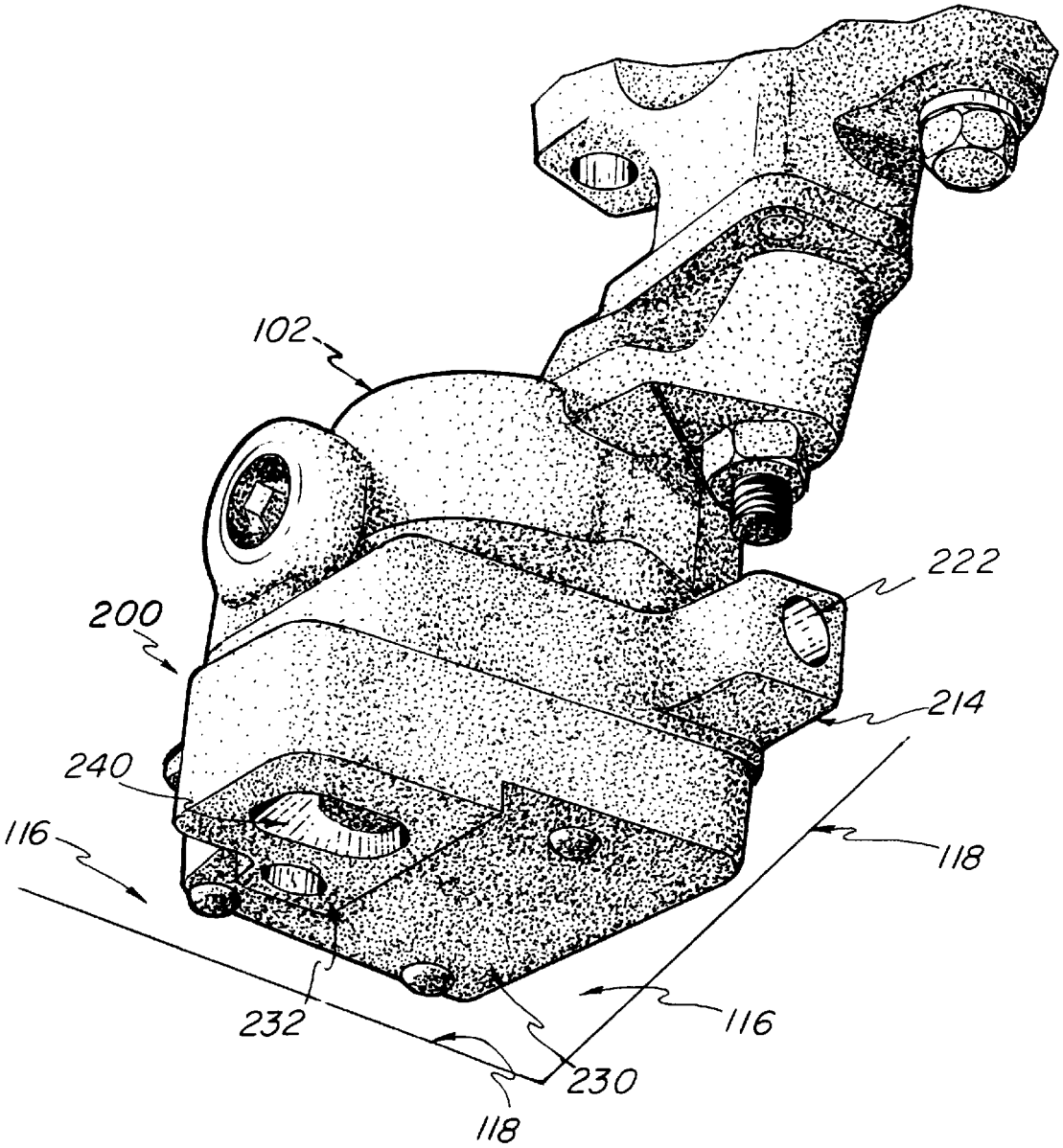
FIG. 3 is a perspective side view of a typical oil pump for use with an internal combustion engine of FIG. 1 wherein the prior art oil pump cover plate and pickup tube has been replaced with a preferred embodiment of the oil pump pickup device of the subject invention.
Figure 4:
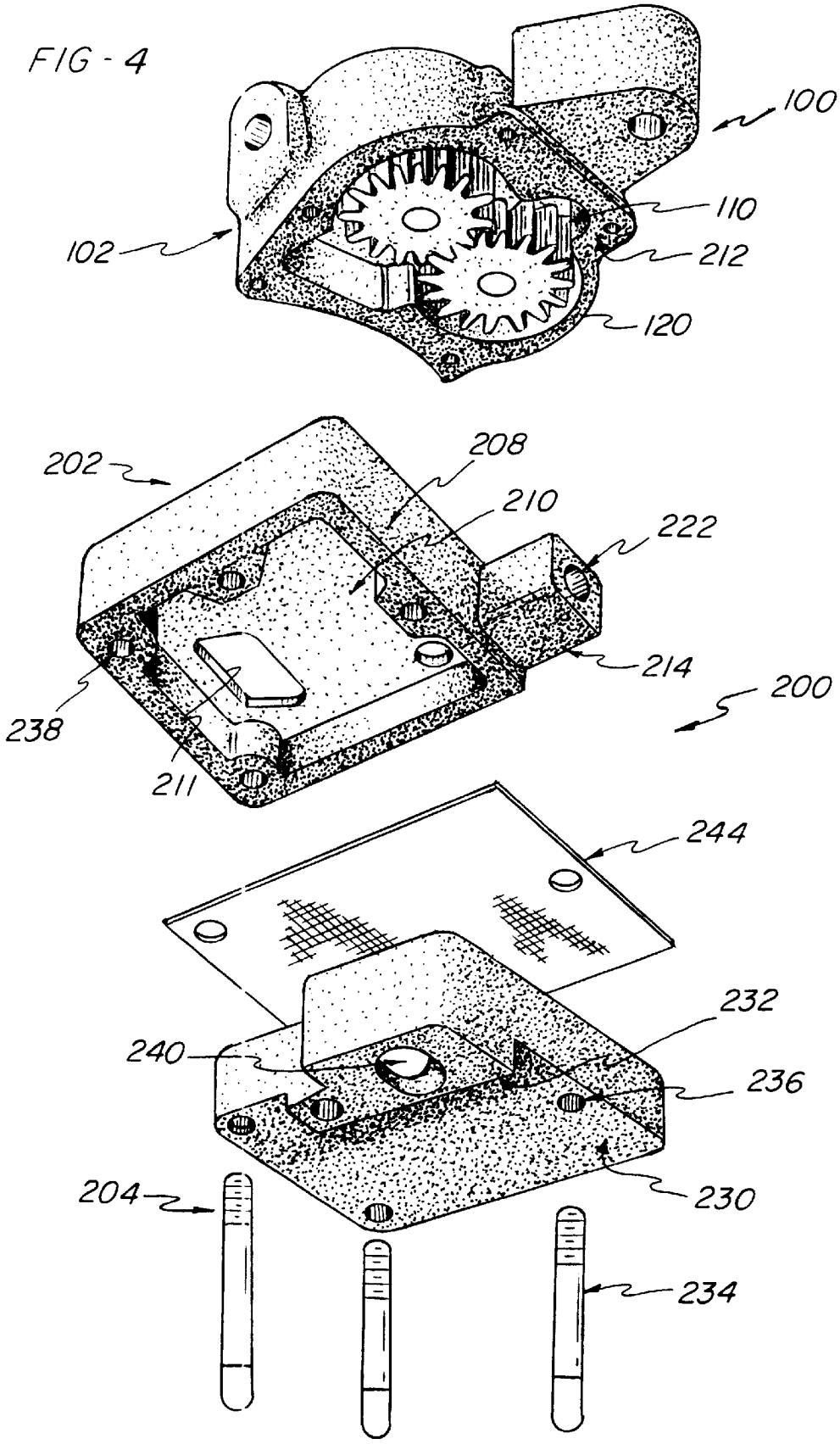
FIG. 4 is a perspective, exploded view of the oil pump pickup device of FIG. 3 showing the oil pump mounting section, the oil pickup section, and the screen mounted therebetween.
Figure 5A:
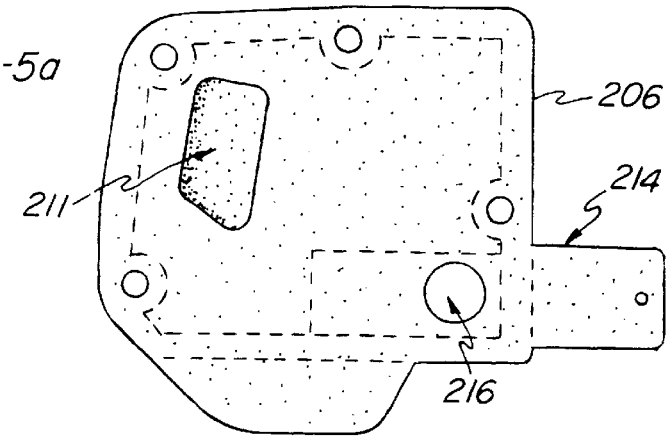
FIG. 5*a*, is a bottom plan view of the oil pump mounting section of the oil pump pickup device.
Figure 5B:
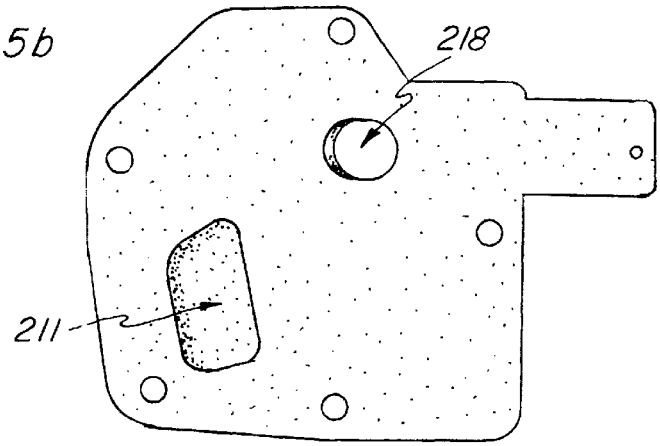
FIG. 5*b*, is a top plan view of the oil pump mounting section of the oil pump pickup device.
Figure 5C:
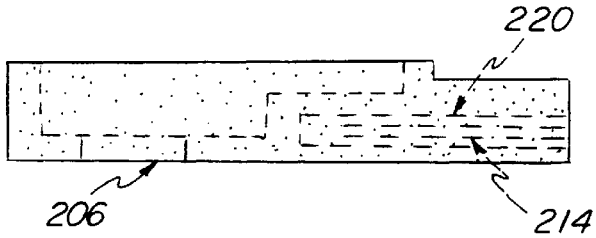
FIG. 5*c*, is a side elevation view of the oil pump mounting section of the oil pump pickup device.
Figure 5C:
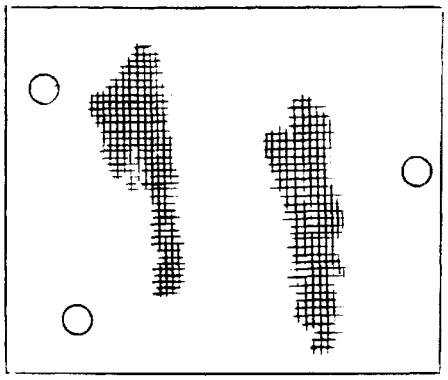
Figure 6A:
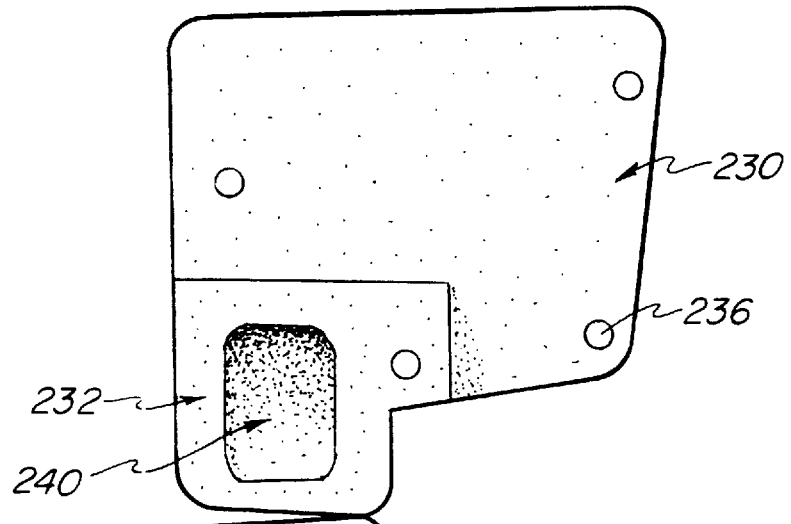
FIG. 6*a*, is a bottom plan view of the oil pickup section of the oil pump pickup device.
Figure 6B:
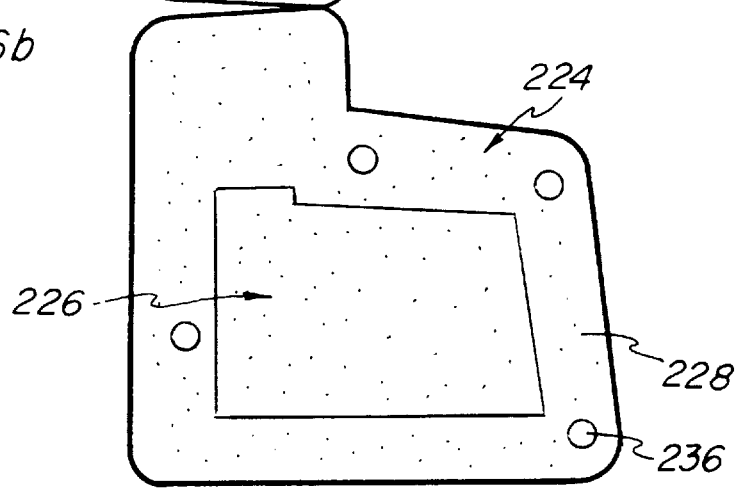
FIG. 6*b*, is a top plan view of the oil pickup section of the oil pump pickup device.
Figure 6C:
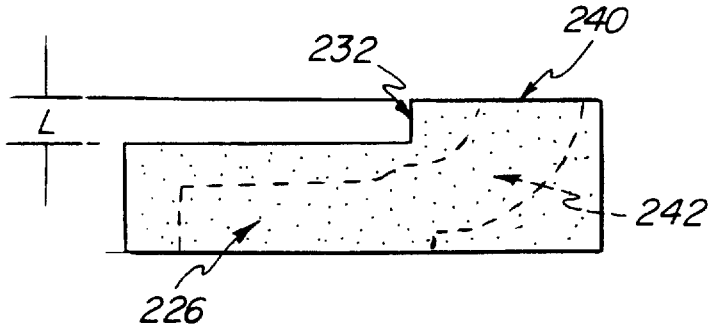
FIG. 6*c*, is a side elevation view of the oil pickup section of the oil pump pickup device.

The oil pickup device of the present invention replaces the standard oil pump cover plate and the pickup tube of a typical oil pump assembly used of an internal combustion engine such as used for automobiles for racing and described hereinabove. Referring to FIGS. 3 and 4, the oil pump pickup device 200 of the subject invention is a two-piece design for simplifying the casting and fabrication of the device and comprises an oil pump mounting section 202 for mounting the oil pump pickup device 200 to a conventional oil pump 100, and an oil pickup section 204 for extending into the oil contained in the engine oil supply reservoir 116 formed within the conventional oil pan 118.

Referring to FIGS. 3, 4 and 5*a* through 5*c*, the oil pump mounting section 202 comprises a generally rectangular front wall 206 and an integral raised flange 208 extending perpendicularly therefrom to define an internal open ended cavity 210. The oil pump inlet 128 is plugged and is replaced by an opening 211 which corresponds in shape to the shape of the suction chamber 108 of the oil pump 100, in the front wall 206 to provide flow communication between the open ended cavity 210 and the suction chamber 108 of the oil pump 100. The shape of the front wall 206 is adapted to complementarily conform with the mating surfaces 212 of the outwardly extending flange 120 of the pump housing 102 to provide an oil seal and for segregating the discharge chamber 110 of the oil pump 100. Extending inwardly and outwardly through the raised flange 208 is an integral, hollow protuberance 214 having first and second openings 216 and 218, respectively, for providing flow communication between the open ended cavity 210 and the discharge chamber 110 of the oil pump 100. A pressure regulating valve 220 is enclosed within the hollow protuberance 214 and cooperates with the first 216 and second 218 openings for regulating the oil pressure within the pump 100. In operation, if the oil pressure level in the discharge chamber 110 is above the prescribed design level, the pressure control valve opens to permit sufficient oil to flow out an external opening 222 and back into the oil supply reservoir 116 to re-establish the prescribed pressure level in the pump 100.

Referring to FIGS. 3, 4, and 6*a* through 6*c*, the oil pickup section 204 comprises a generally rectangular upper face 224 having a recess 226 therein and an outer periphery 228, which serves as a mounting surface for securing the oil pump mounting section 202 to the oil pickup section 204, and a lower face 230 having an outwardly extending protuberance 232. The upper face 224 and the recess 226 are shaped to complementary conform to the shape of the raised flange 208 and the open ended cavity 210, respectively.

The oil pump mounting section 202 and the oil pickup section 204 are secured together and mounted to the oil pump housing 102 by a plurality of fasteners 234, such as bolts, screws, studs and the like, which extend through apertures 236 formed through the oil pickup section 204 which align with corresponding apertures 238 formed through the raised flange 208 in the oil pump mounting section 202 and the threaded bores 126 formed through the oil pump housing 102.

The outwardly extending protuberance 232 includes an opening 240 in flow communication with a channel 242 that runs through the protuberance 232 and the oil pickup section 204 and opens into the recess 226. As can be seen from FIG. 3, the outwardly extending protuberance 232 extends into the oil contained within the engine oil supply reservoir 116 adjacent the bottom of the oil pan 118. The length L of the outwardly extending protuberance 232 can vary depending on the depth of the engine oil supply reservoir 116 and the amount of oil contained therein. It has been found, however, that by selecting the length L of the outwardly extending protuberance to position the opening 240 near the bottom of the oil pan 118, while maintaining a certain minimum distance of about 0.3 to about 0.4 inches between the opening 240 and the bottom of the engine oil pan 118 in order to minimize suction resistance during operation of the oil pump, permits the opening 240 to be sufficiently covered by oil during various driving conditions thereby preventing the aspiration of air and the loss of oil circulation which can endanger the engine.

The oil pickup device 200 may be provided with a screen or filter which serves to eliminate air bubbles in the oil and for preventing particulate matter from entering into the oil pump. In a preferred embodiment, as shown in FIG. 4 of the invention, a screen 244 is shown positioned between the recess 226 formed in the front face 224 of the oil pickup section 204 and the open ended cavity 210 formed in the oil pump mounting section 204 and is secured in place by a plurality of apertures 246 which align with apertures 236 in the oil pickup section 204 and apertures 238 formed through the raised flange 208 for receiving fasteners 234.

To understand how the parts above described are interrelated, the operation of the oil pump pickup device of the subject invention will now be described. During operation, oil is continuously picked up from the engine oil supply reservoir 116 through the opening 240 in the outwardly extending protuberance 232 by suction produced by the oil pump 100 and is directed through channel 242 into recess 226. The recess 226 has a minimum depth of about 0.2 inches thereby ensuring an even distribution of oil. Oil then passes through the screen 244 into the open ended cavity 210 in the oil pump mounting section 202 where it is then directed into the suction chamber 108 of the oil pump 100 through opening 211.

It should be apparent that the oil pump pickup device of the subject invention may be fabricated without welding or brazing operations thereby reducing or eliminating high stress regions which may break resulting in the ingestion of particulate matter and/or in the loss of oil circulation which can endanger the engine.

It should be also be apparent that the two-piece design of the subject invention simplifies the casting and fabrication of the oil pickup device. Further, this configuration permits the device to be easily adapted for use in retrofitting other conventional oil pumps or for use with various sizes of oil pans.

The oil pickup device of the subject invention may be fabricated from an aluminum-based alloy, an iron-based alloy, or the like by machining operations or conventional casting operations. It is also contemplated that the oil pickup device may be fabricated entirely from a one-piece casting.

There has thus been provided a novel oil pickup device for use with an internal combustion engine such as used in an automobile and which is relatively inexpensive to manufacture, easily installed onto a conventional engine oil pump, and effective for supplying a sufficient supply of oil to the oil pump under various driving conditions. The oil pickup device is constructed in such a manner that it will not break during operation and does not require periodic removal or replacement.

While the forms of apparatus described herein constitute preferred embodiments of this invention, it is to be understood that the invention is not limited to these precise forms of apparatus, and that changes may be made therein without departing from the scope of the invention which is defined in the appended claims.

What is claimed is:

1. An oil pump pickup device for use on an oil pump for an internal combustion engine having an oil supply reservoir, wherein the oil pump includes a housing having a suction chamber and a discharge chamber, the oil pump pickup device comprising:

an oil pump mounting section for mounting to the oil pump housing; and an oil pickup section having a protuberance integrally formed with said oil pickup section and which extends outwardly into the oil supply reservoir, said protuberance having an opening therein;

wherein said opening is in flow communication with the suction chamber.

2. The oil pump pickup device of claim 1 wherein said oil pump mounting section comprising a generally rectangular front wall for segregating the discharge chamber and an integral raised flange extending generally perpendicularly therefrom to define an internal open ended cavity, wherein said open ended cavity is in flow communication with said opening in said protuberance and with the suction chamber.

3. The oil pump pickup device of claim 1 further comprising a screen positioned between said oil pump mounting section and said oil pickup section.

4. The oil pump pickup device of claim 1 further comprising a pressure regulating valve for regulating the oil pressure within the pump.

5. The oil pump pickup device of claim 1 wherein said oil pump mounting section and said oil pickup section are secured together.

6. The oil pump pickup device of claim 1 wherein said oil pump mounting section is fabricated from a metallic casting.

7. The oil pump pickup device of claim 1 wherein said oil pickup section is fabricated from a metallic casting.

8. The oil pump pickup device of claim 1 wherein said protuberance is adjacent the bottom of the oil supply reservoir.

9. The oil pump pickup device of claim 2 wherein the shape of said front wall is adapted to complementarily conform to the mating surfaces of the pump housing.

10. An oil pump pickup device for use on an oil pump for an internal combustion engine having an oil supply reservoir, wherein the oil pump includes a housing having a suction chamber and a discharge chamber, the oil pump pickup device comprising:

an oil pump mounting section for mounting to the oil pump housing comprising a front wall and an integral raised flange extending perpendicularly therefrom to define an internal open ended cavity, said front wall having an opening for providing flow communication between said open ended cavity and the suction chamber of the oil pump; and an oil pickup section comprising an upper face having a recess therein and a lower face having an outwardly extending protuberance having an opening therein, wherein said opening is in flow communication with the oil supply reservoir and said recess, and said recess is in flow communication with said open ended cavity.

11. The oil pump pickup device of claim 10 further comprising a screen positioned between said oil pump mounting section and said oil pickup section.

12. The oil pump pickup device of claim 10 further comprising a pressure regulating valve for regulating the oil pressure within the pump.

13. The oil pump pickup device of claim 10 wherein said oil pump mounting section and said oil pickup section are secured together.

14. The oil pump pickup device of claim 10 wherein said oil pump mounting section is fabricated from a metallic casting.

15. The oil pump pickup device of claim 10 wherein said oil pickup section is fabricated from a metallic casting.

16. The oil pump pickup device of claim 10 wherein the shape and size of said opening is said front wall complementarily conforms with the shape and size of said suction chamber.

17. The oil pickup device of claim 10 wherein said recess in said upper face of said oil pickup section has a depth of not less than about 0.2 inches.

18. An oil pump pickup device for use on an oil pump for an internal combustion engine having an oil supply reservoir, wherein the oil pump includes a housing having a suction chamber and a discharge chamber, the oil pump pickup device comprising:

means for attaching the oil pump pickup device to the oil pump housing;

a protuberance integrally formed with said means for attaching the oil pickup device to the oil pump housing and extending outwardly into the oil supply reservoir, said protuberance having an opening in flow communication with the suction chamber of the oil pump; and a screen means positioned between said opening and the suction chamber for preventing particulate matter from entering into the oil pump.

19. The oil pump pickup device of claim 18 further comprising a pressure regulating valve for regulating the oil pressure within the pump.

20. The oil pump pickup device of claim 18 wherein the distance between said opening and the bottom of the oil supply reservoir is about 0.3 to about 0.4 inches.

* * * * *